US007494030B2

(12) United States Patent
Bennett

(10) Patent No.: US 7,494,030 B2
(45) Date of Patent: Feb. 24, 2009

(54) SIFTER DEVICE FOR CONTAINER

(75) Inventor: Kyle M. Bennett, Brown Deer, WI (US)

(73) Assignee: Rexam Beauty and Closures, Inc., Sussex, WI (US)

( * ) Notice: Subject to any disclaimer, the term of this patent is extended or adjusted under 35 U.S.C. 154(b) by 461 days.

(21) Appl. No.: 11/268,091

(22) Filed: Nov. 7, 2005

(65) Prior Publication Data

US 2006/0278665 A1 Dec. 14, 2006

Related U.S. Application Data

(60) Provisional application No. 60/690,318, filed on Jun. 14, 2005.

(51) Int. Cl.
*B67D 3/00* (2006.01)

(52) U.S. Cl. ..... 222/480; 222/142.9; 222/548; 222/565; 132/307

(58) Field of Classification Search ..... 222/182, 222/480, 565, 189.02–189.04, 544, 545, 222/548, 555, 551, 562, 484, 485, 142.1, 222/142.6–142.7, 142.9; 220/541, 543, 253; 132/306, 305, 298, 307, 299, 295
See application file for complete search history.

(56) References Cited

U.S. PATENT DOCUMENTS

| | | | | | |
|---|---|---|---|---|---|
| 1,156,456 | A | * | 10/1915 | Beck | 132/298 |
| 1,642,780 | A | * | 9/1927 | Kole et al. | 132/295 |
| 2,326,839 | A | * | 8/1943 | Cullen | 222/548 |
| 4,488,668 | A | | 12/1984 | Flaska et al. | |
| 4,728,211 | A | * | 3/1988 | Ladd, Jr. | 401/123 |
| 5,383,582 | A | | 1/1995 | Baxter et al. | |
| 6,378,735 | B1 | | 4/2002 | Chu | |
| 6,886,719 | B1 | | 5/2005 | Shen et al. | |
| 2004/0079765 | A1 | | 4/2004 | Gallo, Jr. et al. | |

* cited by examiner

*Primary Examiner*—Frederick C. Nicolas
(74) *Attorney, Agent, or Firm*—Foley & Lardner LLP

(57) ABSTRACT

A container for selectively dispensing a particulate matter, such as a cosmetic loose powder, is provided. The container includes a base having an opening and configured to hold particulate matter, a cover overlying the opening, and a sifter mechanism coupled to the container and movable between a first position and a second position. The sifter mechanism moves between the first position and the second position in response to movement of the cover.

26 Claims, 6 Drawing Sheets

SIFTER DEVICE FOR CONTAINER

CROSS-REFERENCE TO RELATED PATENT APPLICATIONS

This application claims the benefit under 35 U.S.C. 119(e) of U.S. Provisional Application No. 60/690,318, having a filing date of Jun. 14, 2005, titled "LOOSE POWDER CONTAINER," the disclosure of which is hereby incorporated by reference.

BACKGROUND

The present invention relates generally to the field of storage systems or containers for storing and dispensing materials. The present invention more specifically relates to storage systems or containers for storing and dispensing a loose powder material (e.g., a cosmetic powder, etc.) or any other particulate matter.

It is generally known to provide a container for storing a loose powder. Such known containers typically include a receptacle for supporting the loose powder and a cover coupled to an open end of the receptacle for sealing the receptacle. Such known containers often include a sifter mechanism having a pattern of openings through which the loose powder can be dispensed. It is also known to provide a sifter mechanism comprising two or more parts, each having a pattern of openings. The parts are intended to be selectively rotated relative to each other by a user in a manner that moves the patterns of opening into and out of alignment so as to move the container between an open and closed position. Such known containers are typically large and clumsy thereby making them difficult or burdensome to store in relatively limited spaces (e.g., bags, purses, pockets, etc.). Further, in known containers, the movement of the sifter mechanism is independent from the movement of the other portions of the container (e.g., the cover and/or the receptacle, etc.). As such, a user must separately actuate the sifter mechanism between the open and closed positions.

Thus there is a need for a conveniently sized container (such as a cosmetic compact) having a sifter mechanism that can substantially seal off a loose powder contained therein. There is also a need for a container having a sifter mechanism wherein actuation of a cover and/or base of the container actuates the sifter mechanism between an open and closed position. There is further a need for a container having a sifter mechanism to be capable of supporting an applicator used for applying a loose powder stored within the container. The is further a need for a container for storing a loose powder that can be moved to a latched or locked position.

Accordingly, it would be desirable to provide a container capable of accomplishing any one or more of these or other needs.

SUMMARY

An exemplary embodiment relates to a container for supporting particulate matter. The container includes a base having an opening, a cover overlying the opening, and a sifter mechanism configured to move between a first position and a second position. The sifter mechanism includes a first platform having at least one dispensing aperture extending therethrough, and a second platform having at least one dispensing aperture extending therethrough. Movement of the cover moves the first platform relative to the second platform.

Another exemplary embodiment relates to a cosmetic compact for selectively dispensing a loose powder. The cosmetic compact includes a container having an opening and configured to hold the loose powder, an impermeable cover rotatably supported at the opening, and a sifter mechanism coupled to the container and movable between a first position and a second position. Rotational movement of the impermeable cover causes the sifter mechanism to move between the first and second positions.

Another exemplary embodiment relates to a container system for supporting particulate matter. The system includes a container means, a cover means movable relative to the container means between a first position and a second position, and a sifter means for controlling the dispensing of particulate matter from the container means and movable between a closed position and an open position in response to the movement of the cover between the first position and the second position. The cover means is configured to be removed from the container when in the second position to allowing dispensing of particulate matter.

DETAILED DESCRIPTION

Figure 1:
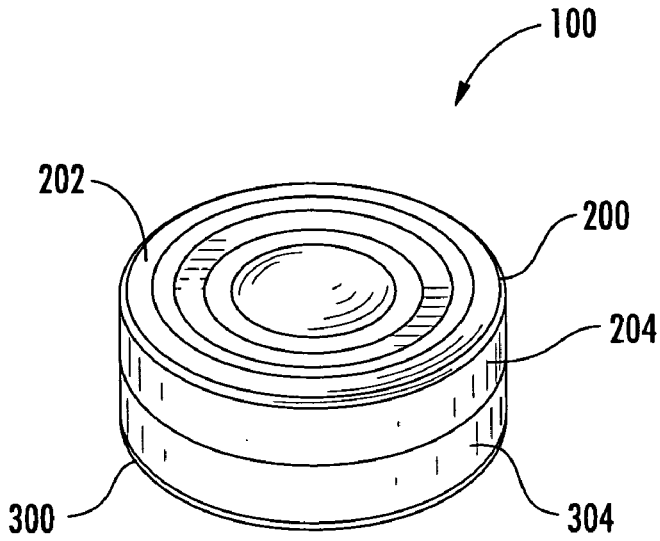
FIG. 1 is a top perspective view of a container in a closed position according to one exemplary embodiment.
Figure 2:
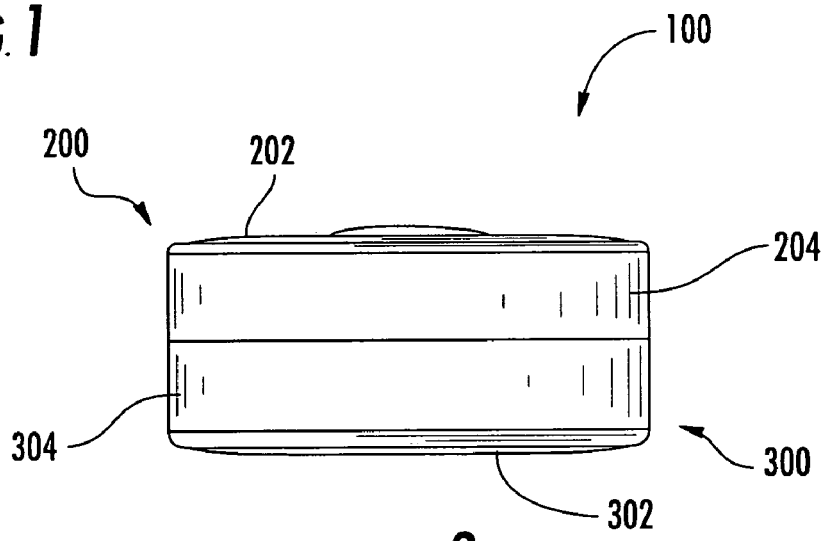
FIG. 2 is a side plan view of the container of FIG. 1.
Figure 3:
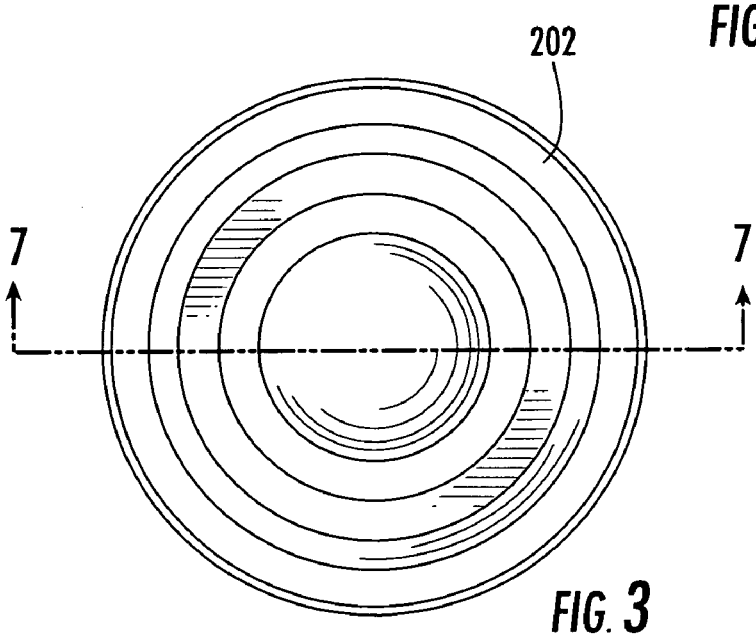
FIG. 3 is a top plan view of the container of FIG. 1.

Referring generally to the FIGURES, a container is shown according to one nonexclusive exemplary embodiment. The container (shown schematically as a container 100) comprises a first portion (e.g., lid, closure, top, etc.), shown schematically as a cover portion 200, a second portion (e.g., bottom, receptacle, etc.), shown schematically as a base portion 300, and third portion (e.g., dispensing mechanism, shaker portion, etc.), shown schematically as a sifter mechanism 400 (shown in FIG. 5). The first portion and second portion cooperate to provide a conveniently sized storage system suitable for holding a particulate matter, such as a cosmetic substance (e.g., loose powder, etc.). The container is preferably sized to conveniently fit into a user's bag, purse, pocket, etc. The third portion is configured to control how the particulate matter is dispensed from the container (e.g., the third portion may control the amount of particulate matter that is dispensed, and/or may control the direction or pattern in which particulate matter is dispensed, etc.).

The third portion generally comprises a first platform (shown schematically as a first sifter plate 410) and a second platform (shown schematically as a second sifter plate 430). The first platform and the second platform include one or more apertures (e.g., an array or pattern of relatively small holes, etc.) through which particulate matter can be dispensed. According to an exemplary embodiment, the first platform is disposed adjacent to the second platform and is configured for rotational movement relative to the second platform between a first position (wherein the apertures in the first platform are at least slightly out of alignment with the apertures in the second platform) and a second position (wherein the apertures in the first platform are in greater alignment with the apertures in the second platform than when in the first position). The second platform is preferably coupled to the second portion in a manner that impedes the rotational movement of the second platform relative to the second portion. For such an embodiment, the first platform is operatively coupled to the first portion when the first portion engages the second portion such that the first platform rotates relative to the second platform as a user rotates the first portion relative to the second portion (i.e., the rotational movement of the first platform is substantially synchronized to the rotational movement of the first portion).

One advantageous feature of the third portion is that the container 100 can provide a substantially sealed environment for particulate matter (e.g., a loose powder, etc.) when the container 100 is in the storage position (e.g., a closed and/or latched position, etc.). Providing a substantially sealed environment for particulate matter stored within the container may reduce the likelihood that such particulate matter will undesirably leak or otherwise spill from the container. Further, providing a substantially sealed environment for particulate matter stored within the container may assist in maintaining the "freshness" or "effectiveness" of such particulate matter. One advantageous feature of operatively coupling (e.g., synchronizing, etc.) the rotational movement of the third portion to the rotational movement of the first portion is that a user may simultaneously move the third portion and the first portion to an opened position through a single actuation of the first portion. This may simplify opening and closing the container for a user since once the user removes the first portion from the second and third portions, the third portion is already in a dispensing position. Likewise, to return the container to the storage position, a user only has to engage and/or latch the first portion to the second portion thereby causing the third portion to substantially seal the material without any additional effort on the part of the user.

Referring to FIGS. 1 through 4, a cover portion 200 of a container 100 is shown according to an exemplary embodiment. The cover portion 200 has an end wall 202 (e.g., platform, top, top surface, etc.) and a side wall 204 (skirt, peripheral surface, etc.) extending downward therefrom at an orientation that is generally perpendicular to the end wall 202. The side wall 204 is adapted to fit over a structure surrounding an open end of the base portion 300 (shown schematically as a flange 310). The side wall 204 is generally cylindrical in shape and has a first attachment structure (shown schematically as first projections 206 in FIG. 4) located on an inside surface for engaging a corresponding attachment structure (e.g., guides, recesses, slots, grooves, etc.) on the base portion 300 to detachably couple the cover portion 200 to an open end of the base portion 300.

The first projections 206, which are equally spaced apart about near a lower portion of the side wall 202, are substantially circular in cross-section and outwardly extend from the inside surface of side wall 202 towards a center of the cover portion 200. The distance that the projections 206 outwardly extend (i.e., the depth of the projections 206), is sufficient to engage the corresponding attachment structure provided on the base portion 300. According to the embodiment illustrated, the cover portion 200 includes four projections 206 for the four corresponding attachment structures provided on the base portion 300. According to various alternative embodiments, any number of projections, having any number of suitable cross-sections, and extending from any of a number of surfaces may be used. According to other various alternative embodiments, the first attachment structure may be provided by any of a variety of suitable attachment structures (e.g., threads for engaging corresponding threads on the base portion 300, snap-fit, etc.).

The cover portion 200 further includes the end wall 202 that is orientated generally perpendicular to a central axis of the side wall 204. According to one exemplary embodiment, the end wall 202 and the side wall 204 are integrally formed as a single unitary body in a single mold by an injection molding operation to form the cover portion 200. According to various alternative embodiments, the end wall section may be coupled to the side wall section in any suitable manner (e.g., snap fit, etc.). Depending on various design criteria, the profile of the end wall 202 may vary. According to the embodiment illustrated (and best shown in FIG. 7), the end wall 202 dips down from the periphery and then comes back up to form a substantially circular bulge in a central portion of the end wall 202. According to various alternative embodiments, the end wall 202 may be a substantially flat surface or may any other suitable profile such as a hemisphere, a truncated cone, etc.

The cover portion 200 further includes a second attachment structure (shown schematically as second projections 208) for engaging a corresponding attachment structure (e.g., a cut-out, step, etc.) on a first platform (shown schematically as a top sifter plate 410) of the sifter mechanism 400 to detachably couple the cover portion 200 with the first platform of the sifter mechanism 400 for operatively coupling (e.g., synchronizing, etc.) the rotational movement of the first sifter platform to the rotational movement of the cover portion 200. Referring again to FIG. 4, the second projections 208 are shown as generally rectangular members that outwardly extend from an inside surface of the end wall 202. The cover portion 200 further includes support members 209 (e.g., legs, braces, trusses, ribs, etc.) that extend between the second projections 208 and the inside surface of the end wall 202. The support members 209 are provided to support second projections and are shaped (e.g., sloped, slanted, angled, etc.) to avoid interfering with a cavity 212 defined by the cover portion 200 and the first platform of the sifter mechanism 400.

According to the embodiment illustrated, the cover portion 200 includes four second projections 208 for the four corresponding attachment structures provided on the first platform of the sifter mechanism 400. According to various alternative embodiments, any number of second projections, having any number of suitable cross-sections, and extending from any of a number of surfaces may be used. For example, the second projections may extend from the inside surface of the side wall 204 and be located slightly above the first projections 206. Further, the second projections 208 may be substantially aligned with the first projections 206, or alternatively, may be spaced apart. According to other various alternative embodiments, the attachment structure may be provided by any of a variety of attachment structures suitable for synchronizing the rotational movement of the cover portion 200 with the rotational movement of the first platform of the sifter mechanism 400.

The cover portion 200 further includes a peripheral ledge 210 separating an inside surface of the side wall 204 from an inside surface of the end wall 202. According to the embodiment illustrated, the peripheral ledge 210, which is substantially rectangular in cross-section, is configured as a continuous ring that extends about the inside of the cover portion 200. The peripheral ledge 210 may provide a structure for controlling the depth at which the cover portion 200 engages the base portion 300, may provide a structure for supporting at least one of the first projections 206 and the second projections 208, and/or may improve the rigidity of the cover portion 200. According to various alternative embodiments, the peripheral ledge may be discontinuous and/or may have any number of suitable cross-sections. According to various other alternative embodiments, the peripheral ledge 210 may be removed and a relatively continuous or smooth transition may exist between the inside side wall of the side wall 204 and the inside surface of the end wall 202.

Figure 7:
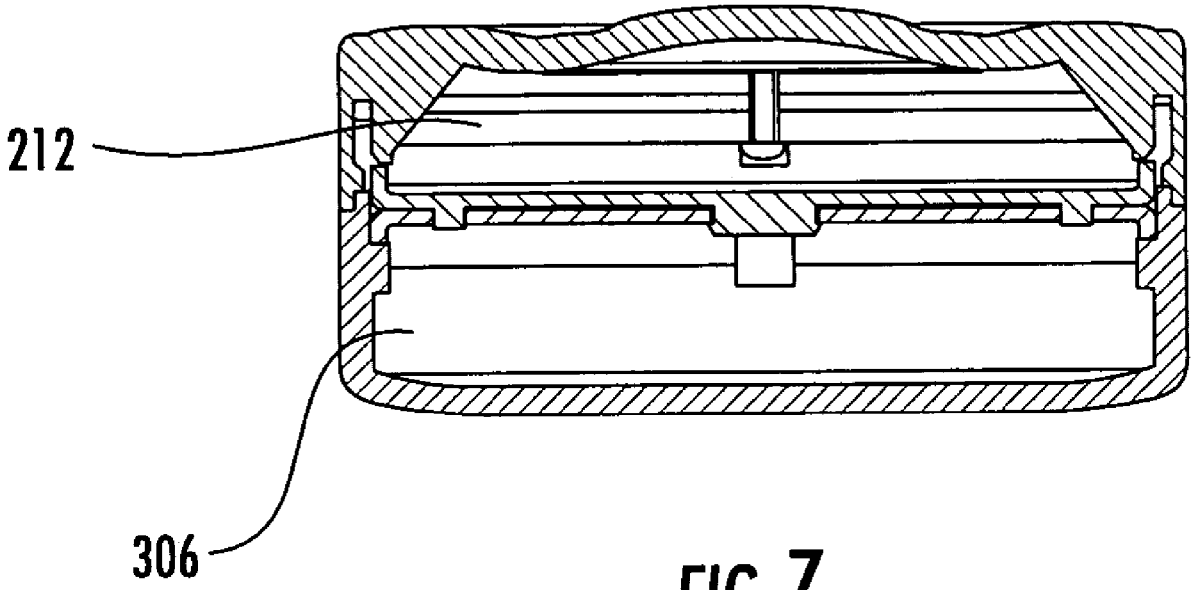
FIG. 7 is a cross-sectional view of the container of FIG. 1 along a line 7-7 of FIG. 3.

The cover portion 200 also partially defines an aperture or cavity 212 when the container 100 is in the closed position. Referring to FIG. 7, the cavity 212 is defined by the end wall 202, the side wall 204, and the first platform of the sifter mechanism 400. According to one exemplary embodiment, the cavity 212 is sized to receive an applicator (not shown) that may be useful in applying particulate matter stored within the base portion 300. For example, the cavity 212 may be sized to hold a cloth, sponge, pad, or the like suitable for applying a loose powder.

Referring to FIGS. 1 through 5, a base portion 300 of the container 100 is shown according to an exemplary embodiment. The base portion 300 has an end wall 302 (e.g., platform, bottom, bottom surface, etc.) and a side wall 304 extending upward therefrom at an orientation that is generally perpendicular to the end wall section 302. The side wall 304 is generally cylindrical in shape and defines an aperture 306 (e.g., cavity, receptacle, etc.) suitable for supporting particulate matter such as a cosmetic substance, foodstuff, cleaning soaps, or any other particulate material.

The size and shape of the aperture 306 may vary depending on a number of design criteria. According to an exemplary embodiment, the aperture 306 has a volume between approximately 1.5 cubic inches and approximately 8 cubic inches. According to various alternative embodiments, the aperture 306 may have a volume greater than or less than the range provided. Limiting the volume of the aperture 306 allows the overall size of the container 100 to be minimized, thereby allowing the container 100 to be conveniently carried or stowed in relatively size restricted areas (e.g., pockets, purses, backpacks, etc.) by the user. According various alternative embodiments, aperture 306 may be divided into two or more compartments (e.g., storage wells, etc.) for separating multiple particulate matters.

Figure 5:
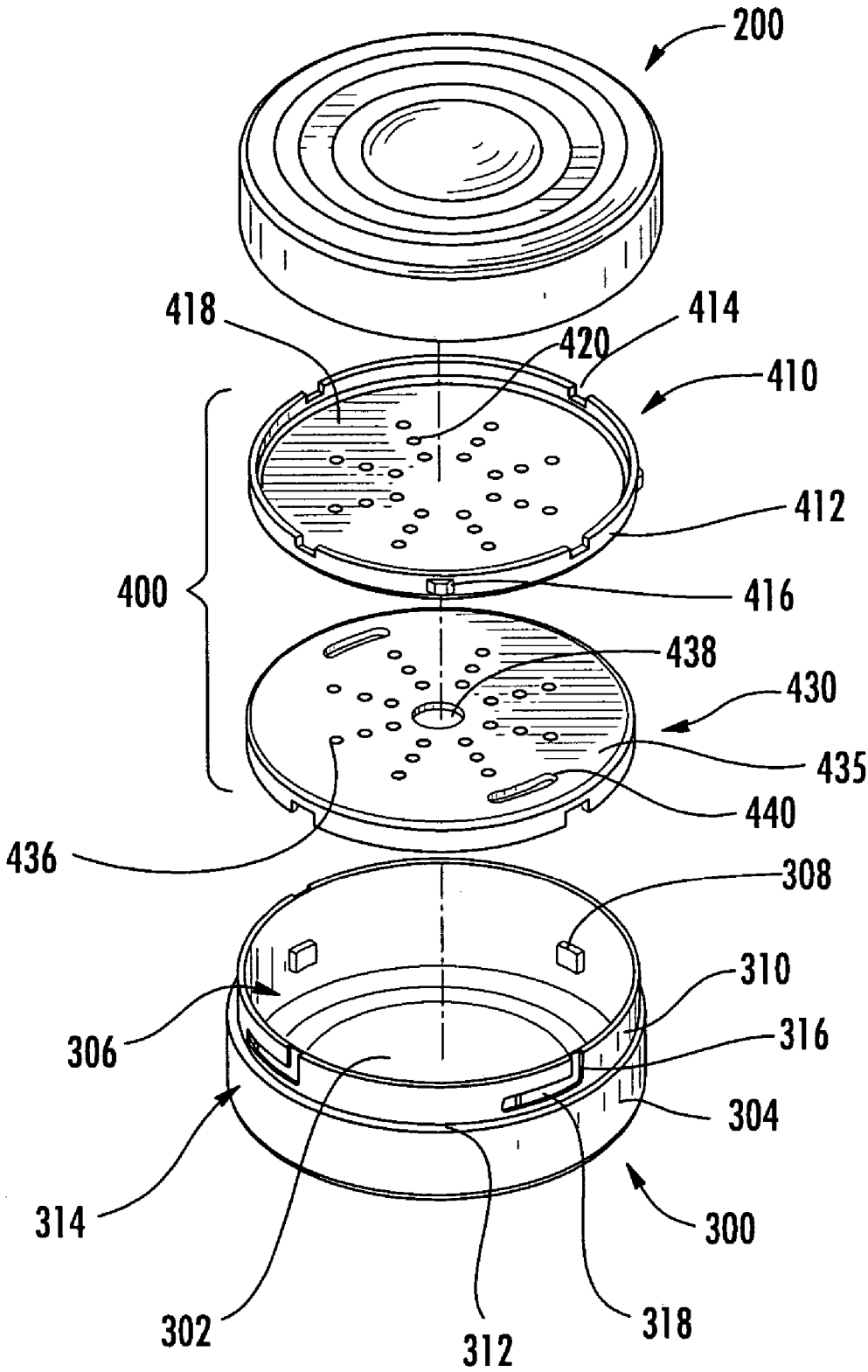
FIG. 5 is an exploded top perspective view the container of FIG. 1.

Referring to FIG. 5, the base portion 300 also includes an attachment structure (shown schematically as a plurality of projections 308) located on an inside surface of the side wall 304 for engaging a corresponding attachment structure (e.g., cut-outs, notches, etc.) on a second platform (shown schematically as a bottom sifter plate 430) of the sifter mechanism 400 to secure the second platform to the base portion 300. According to one exemplary embodiment, the attachment structure secures the second platform in a manner intended to preclude the second platform from rotating as the first platform of the sifter mechanism 400 rotates relative thereto. According to the embodiment illustrated, the base portion 300 includes four projections 308 for the four corresponding attachment structures provided on the second platform. According to various alternative embodiments, any number of projections, having any number of suitable cross-sections, and extending from any of a number of surfaces may be used. According to other various alternative embodiments, the attachment structure may be provided by any of a variety of suitable attachment structures (e.g., a slot configured to receive a projection on the second platform, threads for engaging corresponding threads on the second platform, snap-fit, etc.). According to still other various alternative embodiments, the attachment structures of the base portion 300 may be eliminated and the second platform of the sifter mechanism may be coupled to the base portion 300 using a mechanical fastener (e.g., clips, screws, etc.), an adhesive, a welding operation, or any other suitable technique.

The base portion 300 further includes an extension (shown schematically as a flange 310) upwardly extending from an open end of the side wall 304. According to one exemplary embodiment, the flange 310 and the side wall 304 are integrally formed as a single unitary body in a single mold by an injection molding operation to form the base portion 300. According to various alternative embodiments, the flange may be coupled to the side wall in any suitable manner (e.g., welding, snap fit, etc.). According to an exemplary embodiment, the flange 310 is concentrically aligned with the side wall 304 and has an outer surface with a diameter that is less than the diameter of the outer surface of the side wall 304. For such an embodiment, a ledge or lip 312 is formed between the outer surface of the flange 310 and the outer surface of the side wall 304. Preferably, the width of the lip 312 is substantially that of the thickness of the side wall 204 of the cover portion 200. In this manner, there will a relatively smooth transition between corresponding outer surfaces of the cover portion 200 and the base portion 300 when the cover portion 200 is fitted over the open end of the bottom portion 300.

Figure 6:
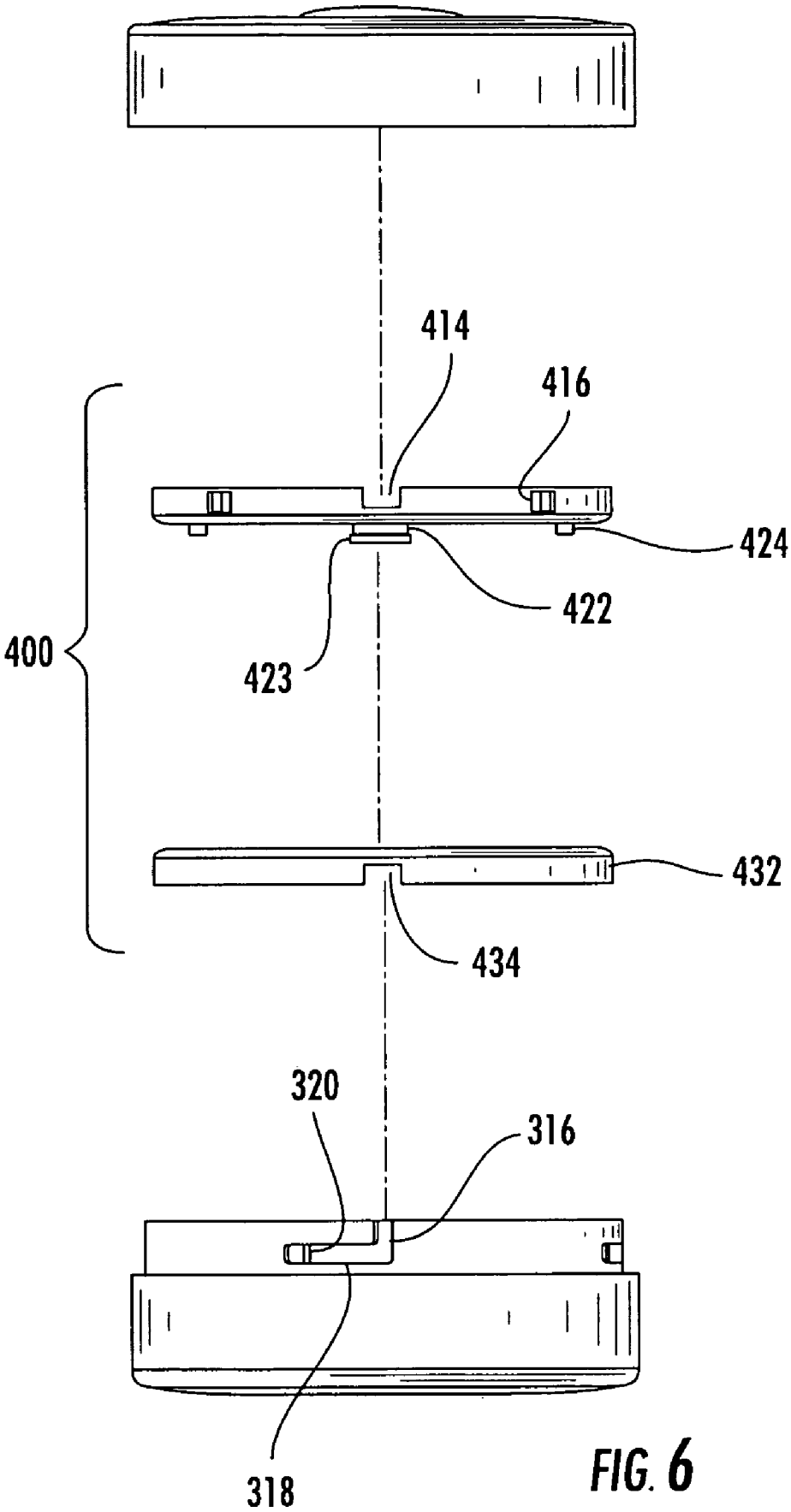
FIG. 6 is an exploded side plan view of the container of FIG. 1.

Referring to FIGS. 5 and 6, base portion 300 further includes an attachment structure (shown schematically as a plurality of guides or channels 314) located on an outer surface of the flange 310 for engaging a corresponding attachment structure (e.g., first projections 206) on the cover portion 200 to releasably couple the cover portion 200 to an open end of the base portion 300. According to one exemplary embodiment, the channels 314 are L-shaped recesses having a first leg 316 extending from a free end of the flange 310 in a first direction that is substantially vertical and a second leg 318 extending from a bottom portion of first leg 316 in a second direction that is substantially horizontal. In such an embodiment, the channels 314 are configured to receive the first projections 206 of the cover portion 200. The cover portion 200 is applied by aligning the first projections 206 with the first legs 316 of the channels 314 and allowing the cover portion 200 to be fitted over the base portion 300 until movement in a vertical direction is impeded. The cover portion 200 is then rotated (e.g., in a clockwise direction, etc.) thereby causing the first projections 206 to slidably engage the second legs 318 of the channels 314. The distance that the cover portion 200 can be rotated is restricted by the length of the second legs 318.

The base portion 300 further includes a latching structure (shown schematically as a plurality of projections or tabs 320) located in the second legs 318 of the channels 314 near an end opposite of the first legs 316 for releasably engaging the first projections 206 of the cover portion 200 to secure the cover portion 200 in the storage position. According to one exemplary embodiment, tabs 320 provide a camming surface that first projections 206 are configured to slidably engage and "snap-over" as the cover portion 200 is being rotated relative to the bottom portion 300. Use of tabs 320 is intended to retain the container 100 in the storage position until a user selectively rotates the cover portion 200 to access particulate matter stored within. According to various exemplary embodiments, any other suitable latching structure may be used for securing the container 100 in the storage position.

Figure 4:
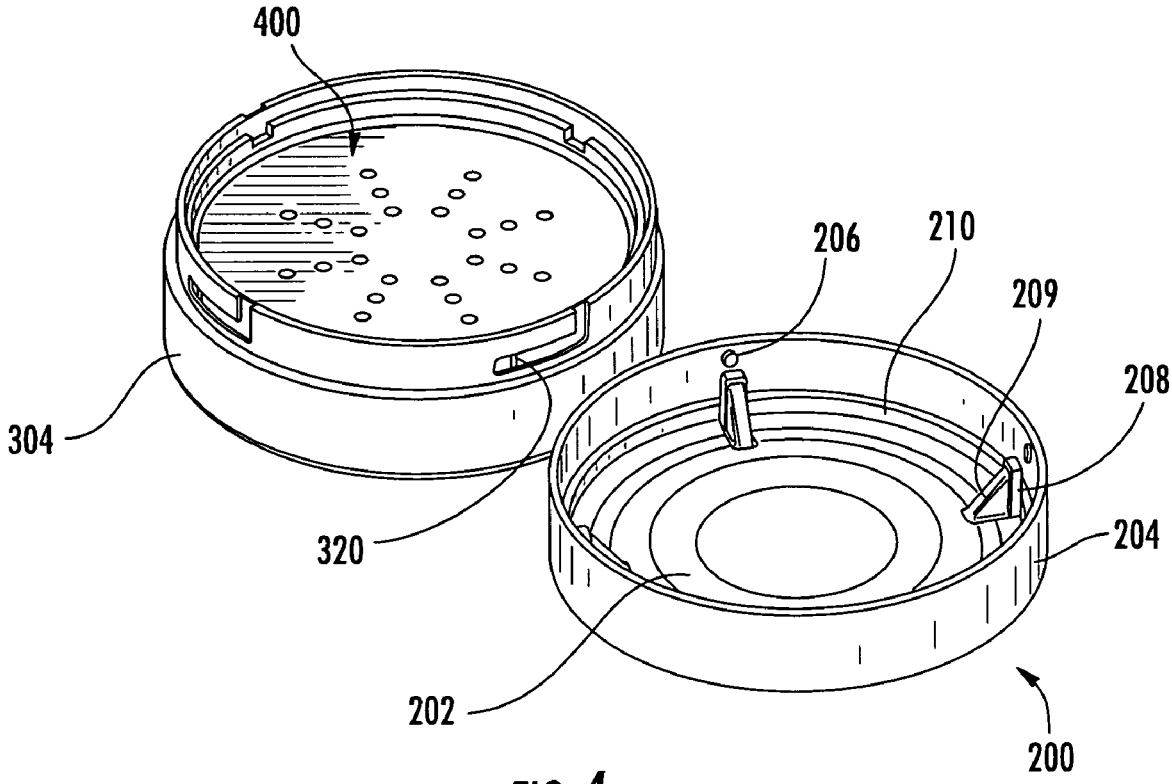
FIG. 4 is a top perspective view of the container of FIG. 1 in an open position.

Referring to FIGS. 4 through 7, a sifter mechanism 400 of the container 100 is shown according to an exemplary embodiment. The sifter mechanism 400 is configured to control how particulate matter stored within the aperture 306 is dispensed from the container 100. The sifter mechanism 400 may control the direction or pattern in which particulate matter is dispensed from the container 100 and/or may control the amount of particulate matter that is dispensed from the container 100 (i.e., the flow rate). Referring to FIG. 4 in particular, the sifter mechanism 400 is configured to be received and supported by the base portion 300. The base portion 300 supports the sifter mechanism 400 at an orientation spaced apart from the end wall 302 to sufficiently store a material within the aperture 306.

Referring to FIG. 5, the sifter mechanism 400 generally comprises a first platform (shown schematically as a top sifter plate 410) and a second platform (shown schematically as a bottom sifter plate 430). The sifter mechanism 400 is configured to move between a first position (wherein one or more sifter holes or openings in the top sifter plate 410 are at least slightly out of alignment with one or more sifter holes or openings in the bottom sifter plate 430) and a second position (wherein the one or more sifter openings in the top sifter plate 410 are in greater alignment with one or more sifter openings in the bottom sifter plate 430 such that a particulate matter stored in the base portion 300 can be dispensed through the sifter openings in the top sifter plate 410). According to the embodiment illustrated, the sifter mechanism 400 is configured to substantially seal the aperture 306 when in the first position such that the likelihood of leakage or spillage of particulate matter stored within the base portion 300 from the container 100 and/or into other portions within the container 100 can be reduced.

Still referring to FIG. 5, the top sifter plate 410 has a side wall 412 that is generally cylindrical and has an attachment structure (shown schematically as cut-outs or notches 414) located in a free end of the side wall section 412 for detachably engaging a corresponding attachment structure (e.g., the second projections 208) on the cover portion 200. According to one exemplary embodiment, the side wall 412 includes four notches 414 that are generally rectangular in shape and configured to detachably engage the second projections 208 of the cover portion 200. The notches 414 and the second projections 208 cooperate to provide for the relatively simultaneous rotational movement of top sifter plate 410 in response to the rotational movement of the cover portion 200. According to various alternative embodiments, any number of notches or equivalent structures, having any of a number of cross-sections may be provided to correspond to the particular attachment structure on the cover portion 200.

The top sifter plate 410 also includes a spacing or clearance structure (shown schematically as a plurality of projections or spacers 416) located on an outer surface of the side wall 412. Use of spacers 416 may be used to reduce the surface contact (i.e., friction) between the outer surface of the side wall 412 and the inside surface of the base portion 300 by reducing the surface area of the side wall 412 that is in contact with the base portion 300 as the top sifter plate 410 rotates relative to the bottom sifter plate 430. The spacers 416 are equally spaced apart about the periphery of the side wall 412 to provide for balanced rotation of the top sifter plate 410. According to other embodiments, the spacers 416 may be eliminated and the outer surface of the side wall 412 may be configured to slidably engage the inside surface of the base portion 300 as the top sifter plate 410 is rotated relative to the bottom sifter plate 430. According to still other embodiments, the top sifter plate 410 may be sized such that it will not slidably engage the inside surface of the base portion 300 as the top sifter plate is rotated relative to the bottom sifter plate (e.g., by having a smaller diameter than the inside surface of the base portion 300).

The top sifter plate 410 further includes an end wall 418 that is orientated generally perpendicular to a central axis of the side wall 412. The end wall 418 includes one or more sifter openings 420 (shown schematically as twenty-four relatively small circular openings configured in a star-like pattern). Each of the sifter openings 420 extend through the end wall 418 for providing a conduit through which a particulate matter stored within the aperture 306 can be dispensed when the sifter openings 420 are aligned with corresponding sifter opening in the bottom sifter plate 430. According to various alternative embodiments, the sifter openings may have any suitable shape, size, number and pattern. For example, the end wall of the top sifter plate may include one sifter opening or it may include two or more sifter openings, and each sifter opening may have a shape and size that is suitable to the application in which the container will be used. For example, one or more of the sifter openings may be circular, rectangular, tear-drop shaped, crescent-shaped, or one of a variety of other suitable shapes.

Referring to FIG. 6, the top sifter plate 410 further includes an alignment structure (shown schematically as a projection or pilot 422) located in a central region of and downwardly extending from the underside surface of the end wall 418. According to one exemplary embodiment, the pilot 422 has a generally circular cross-section and is configured to engage a corresponding alignment structure (e.g., a recess, aperture, opening, etc.) on the bottom sifter plate 430 to align the top sifter plate 410 with the bottom sifter plate 430. According to one exemplary embodiment, the free end of the pilot 422 includes a projection or raised lip 423. The raised lip 423 may assist in retaining the top sifter plate 410 to the bottom sifter plate 430 in a desired position. The diameter of the raised lip 423 is preferably the same or slightly larger than the diameter of the opening in the bottom sifter plate 430 into which the pilot 422 is inserted.

Still referring to FIG. 6, the top sifter plate further includes a guide structure (shown schematically as a pair of projections or pegs 424) locate on a relatively outer perimeter of and downwardly extending from the underside surface of the end wall 418. According to one exemplary embodiment, the pegs 424 have a generally circular cross-section and are configured to slidably engage a corresponding guide structure (e.g., a slot, channel, groove, etc.) on the bottom sifter plate 430 to guide the top sifter plate 410 as it rotates relative to the bottom sifter plate 430. The corresponding guide structure on the bottom sifter plate 430 may also restrict the distance in which the top sifter plate 410 can rotate relative to the bottom sifter plate 430. According to various alternative embodiments, the guide structure may have any one of a variety of suitable cross-sections. According to other alternative embodiments, the guide structure may include a continuous rim, flanges, sleeves or other types of suitable structures that are configured to guide the rotational movement of the top sifter plate 410 relative to the bottom sifter plate 430.

Referring further to FIG. 6, the bottom sifter plate 430 is shown according to one exemplary embodiment. The bottom sifter plate 430 has a side wall 432 adapted to engage the base portion 300. According to one exemplary embodiment, the bottom sifter plate 430 may be configured to releasably engage the base portion 300 or may be fixedly engaged to the base portion 300. Releasably engaging the bottom sifter plate 430 to the base portion 300 may allow a user to replenish (e.g., refill, etc.) the aperture 306 with particulate matter when desirable (e.g., when such particulate matter is exhausted, etc.). The side wall 432 is generally cylindrical and has an attachment structure (shown schematically as cut-outs or notches 434) located in a free end of the side wall 432 for engaging a corresponding attachment structure (e.g., projections 308) on the base portion 300. The notches 434 and the projections 308 cooperate to restrict the rotational movement of the bottom sifter plate 430. According to one exemplary embodiment, the side wall 432 includes four notches 434 that are generally rectangular in shape. According to various alternative embodiments, any number of notches 434 or equivalent structure may be provided to correspond to the particular attachment structure on the base portion 300. For example, the bottom sifter plate 430 may include one or more projections or ribs configured to engage a suitable structure on the base portion 300.

The bottom sifter plate 430 further includes an end wall 435 that is orientated generally perpendicular to a central axis of the side wall 432. The end wall 435 includes one or more sifter openings 436 (shown schematically as twenty-four relatively small circular openings configured in a star-like pattern). Each of the sifter openings 436 extend through the end wall 435 for providing a conduit through which a particulate matter stored with cavity 306 can be dispensed when the sifter openings 420 of the top sifter plate 410 are at least partially aligned with the sifter openings 436. According to one exemplary embodiment, the sifter openings 436 are provided in the same pattern as the sifter openings 420 in the top sifter plate 410. According to various alternative embodiments, the sifter openings of the bottom sifter plate may have any suitable shape, size, number and pattern. Further, the configuration and/or layout of the sifter openings of the bottom sifter plate may be the same or different than the sifter openings in the top sifter plate.

The bottom sifter plate 430 further includes an alignment structure (shown schematically as an opening 438) located in a central region of the end wall 435. According to one exemplary embodiment, the opening 438 has a generally circular cross-section and is configured to engage a corresponding alignment structure (e.g., the pilot 422) on the top sifter plate 410 to align the top sifter plate 410 with the bottom sifter plate 430.

The bottom sifter plate further includes a guide structure (shown schematically as a pair of channels or slots 440) locate on a relatively outer perimeter of the end wall 435. According to one exemplary embodiment, the slots 440 have a generally sectorial in shape and are configured to receive a corresponding alignment structure (e.g., pegs 424) on the top sifter plate 410 to guide the top sifter plate 410 as it rotates relative to the bottom sifter plate 430. The corresponding guide structure on the bottom sifter plate may also restrict the distance in which the top sifter plate 410 can rotate relative to the bottom sifter plate 430. According to one exemplary embodiment, rotation of the top sifter plate 410 is limited to approximately an eighth of a turn relative to the bottom sifter plate 430. According to various alternative embodiments, rotation may be limited to distances greater or less than an eighth of a turn and/or the guide structure may not be used to control the rotational distance of the top sifter plate 410 and accordingly may be sized larger than the distance in which the top sifter plate 410 is capable of rotating.

Figure 8:
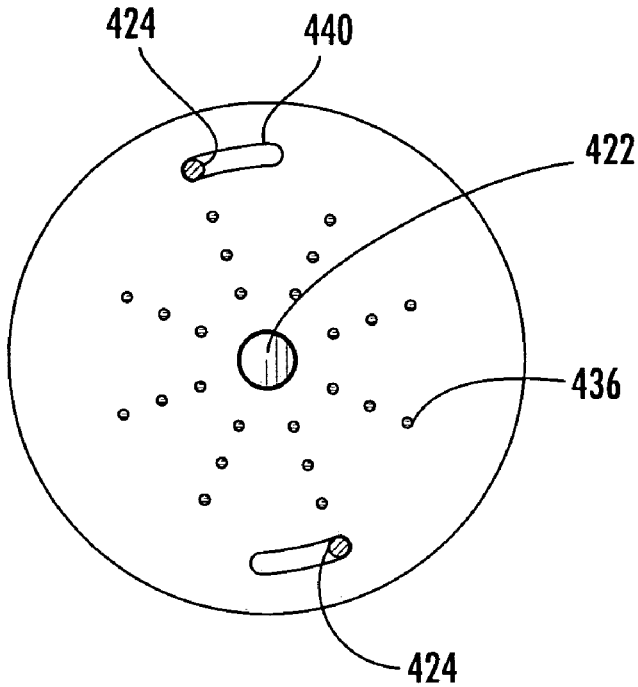
FIG. 8 is a bottom plan view of a sifter mechanism of the container of FIG. 1 in a closed position.

With reference to FIGS. 1, 4, and 7, the operation of the container 100 will be described according to one nonexclusive exemplary embodiment. FIG. 1 shows the container 100 in the storage position (e.g., closed and latched). In the storage position, a particulate matter (e.g., loose powder, etc.) stored within in the aperture 306 of the base portion 300 is substantially sealed off from by the sifter mechanism 400. To seal off the aperture 306, the top sifter plate 410 is orientated relative to the bottom sifter plate 430 such that the sifter openings 420 in the top sifter plate 410 are at least partially out of alignment with the sifter openings 436 in the bottom plate 430 (shown in FIG. 8). In this position, an applicator (e.g., a pad, etc.) may be provided in the cavity 212 and supported by the top sifter plate 410.

Figure 9:
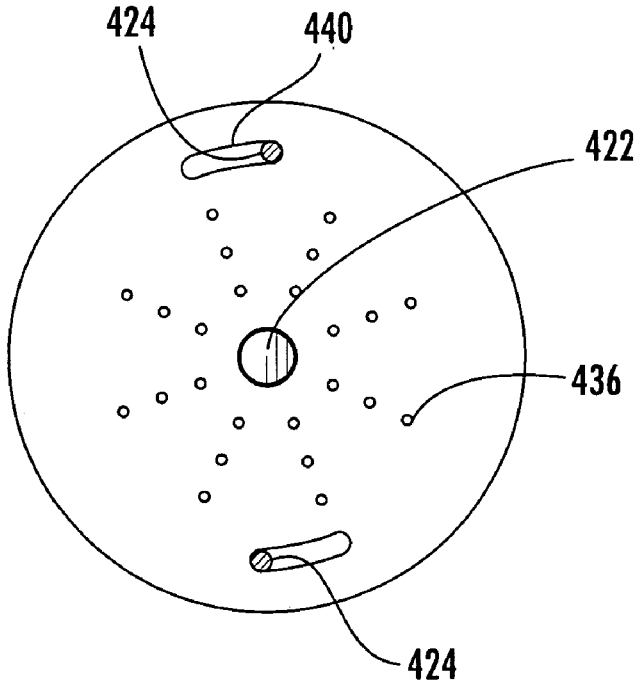
FIG. 9 is a bottom plan view of a sifter mechanism of the container of FIG. 1 in an open position.

To access particulate matter stored within aperture 306, a user must first rotate (e.g., in a counterclockwise direction, etc.) the cover portion 200 while holding or otherwise securing the base portion 300. Preferably, a user need only rotate the cover portion a short distance (e.g., approximately an eighth of a turn, etc.) until rotational movement of the cover portion 200 is impeded by the channels 314 provided in the base portion 300. The top sifter plate 410 is detachably coupled to the cover portion 200 via second projections 308 and notches 434 such that the top sifter plate 410 is simultaneously rotated as the cover portion 200 is rotated. At the time rotational movement of the cover portion 200 is impeded, the sifter openings 426 in the top sifter plate 410 are substantially aligned with the sifter openings 436 in the bottom sifter plate 430 (shown in FIG. 9). In this position, the sifter mechanism 400 is in an open position and particulate matter stored in aperture 306 may be dispensed through the sifter openings 420 and 436.

If an applicator is provided in the container 100, the user at this time, while holding the cover portion 200 and the base portion 300, may shake or otherwise agitate the container 100 to cause particulate matter to be applied to an applicator. The cover portion 200 may then be lifted in a substantially vertical direction to disengage the cover portion 200 from the base portion 300 and the sifter mechanism 400. When removed, the cover portion 200 may be completely detached from the base portion 300 (as shown) or may remain attached via a strap, cord, hinge, or some other coupling device. The sifter mechanism remains in the base portion 300 when the cover portion 200 is removed. If an applicator is provided, the user may utilize the applicator to apply such particulate matter. If an applicator is not provided, the user may tilt the base portion 300 to dispense such particulate matter through one or more of the sifter openings 420 and 436.

To return the container 100 to the storage position, the cover portion 200, with first projections 206 aligned with channels 314, is fitted over the flange 310 of the base portion 300 until movement in a vertical direction is restricted. At this point, the cover portion 200 is rotated relative to the base portion 300 (e.g., in a clockwise direction, etc.). While rotating, the first projections 206 engage tabs 320 to releasably lock or latch the cover portion 200 to the base portion 300. Preferably, a user does not have to rotate the cover portion 200 a substantial distance before a latched position is obtained. Rotational of the top sifter plate 410 is relatively synchronized with that of the cover portion 200. such that once the cover portion 200 is latched, the sifter openings 420 in the top sifter plate 410 are no longer in alignment with the sifter openings 436 in the bottom sifter plate 430.

As one of skill in the art will appreciate from the foregoing disclosure, the present application relates to a number of containers wherein a cover portion is used to control the movement of a sifter mechanism. One nonexclusive exemplary embodiment of a container (e.g., a cosmetic compact, etc.) includes a base portion configured to support a loose powder, a sifter mechanism coupled to the base portion for controlling the dispensing of the loose powder, and a cover portion rotatably coupled to the base portion. The sifter mechanism includes a first sifter platform and a second sifter platform, the first sifter platform is configured to rotate relative to the second sifter platform. Rotation of the first sifter platform is controlled by the cover portion.

As one of skill in the art will further appreciate from the foregoing disclosure, the present application also relates to a number methods of storing and dispensing a loose powder material. One nonexclusive exemplary embodiment relates to storing a loose powder in a base portion, providing a sifter mechanism configured to move between a closed position and an open position, and providing a cover portion configured to control the movement of the sifter mechanism between the closed position and the open position.

It is important to note that the construction and arrangement of the elements of the container as shown in the exemplary embodiment are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Further, the container may be configured in a wide variety of shapes to accommodate varying design criteria. According to an exemplary embodiment, the container has an overall height between approximately 0.5 inches and approximately 2 inches. For such an embodiment, the container may have an width (e.g., diameter, etc.) between approximately 2 inches and approximately 3 inches. Limiting the size of the container to such dimensions allows the container to be conveniently carried and/or stowed by the user. According to various alternative embodiments, the container may be configured into other sizes, as well as other well-known or otherwise suitable shapes having linear and/or non-linear edges and surfaces. For example, the container may be a generally rectangular or octagonal container. Further, for purposes of this disclosure the term "particulate matter" is used broadly to refer to any particulate substance (e.g., powder-like substances, granular substances, or the like, etc.) including cosmetic substances, food substances, cleaning soaps, medical substances, etc. According to various other exemplary embodiments, the container may be configured to support a fluid.

Accordingly, all such modifications are intended to be included within the scope of the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the appended claims.

What is claimed is:

1. A container for supporting particulate matter, the container comprising:

a base having an opening;

a cover overlying the opening; and a sifter mechanism configured to move between a first position and a second position, the sifter mechanism comprising:

a first platform having at least one dispensing aperture extending therethrough and at least one of a central aperture and a central projection; and a second platform having at least one dispensing aperture extending therethrough and at least one of the other one of the central aperture and the central projection, the central projection being configured to be inserted into the central aperture for aligning the second platform with the first platform, wherein movement of the cover moves the first platform relative to the second platform.

2. The container of claim 1, wherein the at least one aperture of the first platform is at least partially aligned with the at least one aperture of the second platform when the sifter mechanism is in the second position to allow dispensing of particulate matter and less aligned with the at least one aperture of the second platform when the sifter mechanism is in the first position to preclude dispensing of particulate matter.

3. The container of claim 2, wherein the at least one aperture of the first platform and the at least one aperture of the second platform comprise a pattern of dispensing apertures.

4. The container of claim 1, wherein the cover is configured to be removed from the base and the sifter mechanism to allow dispensing of particulate matter.

5. The container of claim 4, wherein the cover is independent of the base and the sifter mechanism when removed.

6. The container of claim 1, wherein the cover is configured for rotational movement relative to the base and the first platform is configured for rotational movement relative to the second platform.

7. The container of claim 6, wherein the rotational movement of the first platform is substantially synchronized with the rotational movement of the cover.

8. The container of claim 7, wherein the cover directly engages the first platform for moving the sifter mechanism between the first position and the second position.

9. The container of claim 8, wherein the first platform includes at least one of a slot and a projection and the cover includes at least one of the other of the slot and the projection, the projection is configured to detachably engage the slot.

10. The container of claim 1, wherein the second platform is detachably coupled to the base to allow the container to be refilled with particulate matter.

11. The container of claim 10, wherein the second platform includes at least one of a slot and a projection and the base includes at least one of the other of the slot and the projection, the projection is configured to detachably engage the slot.

12. The container of claim 1, wherein the first platform is supported by the second platform.

13. The container of claim 1, wherein the cover includes one of a tab and a slot and the base includes at least one of the other of the tab and the slot, the tab is configured to releasably engage a slot for selectively securing the cover to the base.

14. The container of claim 1, wherein the container is a cosmetic compact container and the particulate matter is a loose powder.

15. The container of claim 14, wherein the cosmetic compact has a volume between approximately 1.5 cubic inches and approximately 8 cubic inches for holding the loose powder.

16. A container for supporting particulate matter, the container comprising:

a base having an opening;

a cover overlying the opening; and a sifter mechanism configured to move between a first position and a second position, the sifter mechanism comprising:

a first platform having at least one dispensing aperture extending therethrough and at least one of a guide slot and a follower; and a second platform having at least one dispensing aperture extending therethrough and at least one of the other one of the guide slot and the follower, wherein movement of the cover moves the first platform relative to the second platform in a rotational manner and wherein the follower is configured to engage the guide slot for limiting the rotational movement of the first platform relative to the second platform.

17. The container of claim 16, wherein the guide slot is substantially sectorial in shape.

18. The container of claim 17, wherein the guide slot is defined by an end wall of at least one of the first platform and the second platform near a periphery of the end wall.

19. The container of claim 16, wherein the guide slot comprises a first slot and a second slot, and wherein the follower comprises a first projection configured to engage the first slot and a second projection configured to engage the second slot.

20. The container of claim 19, wherein an end wall of the second platform defines the first slot and the second slot, and wherein the first projection and the second projection extend from an end wall of the first platform.

21. The container of claim 20, wherein the first projection and the second projection each have a cross section that is substantially circular in shape.

22. A container for supporting particulate matter, the container comprising:

a base having an opening and including one of a tab and a slot;

a cover overlying the opening and including at least one of the other of the tab and the slot, the tab being configured to releasably engage the slot for selectively securing the cover to the base, the slot being a substantially L-shaped slot having a camming surface for retaining the tab in a latched position; and a sifter mechanism configured to move between a first position and a second position, the sifter mechanism comprising:

a first platform having at least one dispensing aperture extending Therethrough; and a second platform having at least one dispensing aperture extending therethrough, wherein movement of the cover moves the first platform relative to the second platform.

23. The container of claim 22, wherein the cover is configured for rotational movement relative to the base and the first platform is configured for rotational movement relative to the second platform.

24. The container of claim 23, wherein the rotational movement of the first platform is substantially synchronized with the rotational movement of the cover.

25. The container of claim 22, wherein the substantially L-shaped slot comprises a first leg extending downward from an upper edge of the base in a substantially vertical direction and a second leg extending from a bottom portion of the first leg in a substantially horizontal direction.

26. The container of claim 25, wherein the camming surface is defined by a projection provided within the second leg.

* * * * *